United States Patent [19]

Marks et al.

[11] Patent Number: 5,033,659

[45] Date of Patent: Jul. 23, 1991

[54] MECHANICALLY ACTUATED ADDITIVE DISPENSER FOR DISHWASHER

[75] Inventors: Larry D. Marks; Richard C. Stiles, both of St. Joseph Township, Berrien County; William F. Bartloff, City of Eau Claire, Berrien County, all of Mich.

[73] Assignee: Whirlpool Corporation, Benton Harbor, Mich.

[21] Appl. No.: 548,030

[22] Filed: Jul. 5, 1990

Related U.S. Application Data

[60] Division of Ser. No. 250,232, Sep. 28, 1988, which is a continuation-in-part of Ser. No. 900,999, Aug. 27, 1986, abandoned.

[51] Int. Cl.[5] ..... A47L 15/46

[52] U.S. Cl. ..... 222/651; 222/129; 134/57 D; 134/93; 134/99

[58] Field of Search ..... 222/651-652, 222/129, 511, 517-518; 134/56 D, 57 D, 58 D, 93, 95, 99; 68/17 R; 251/263; 137/624.11

[56] References Cited

U.S. PATENT DOCUMENTS

| | | | |
|---|---|---|---|
| 2,872,076 | 2/1954 | Bloom | 222/651 |
| 2,948,437 | 8/1960 | Nielsen | 222/651 |
| 3,012,565 | 12/1961 | Lines | 134/93 |
| 3,102,664 | 9/1963 | Lines | 222/651 |
| 3,125,249 | 3/1964 | Kendt | 222/652 |
| 3,199,733 | 8/1965 | Perl | 222/651 |
| 3,207,373 | 9/1965 | Dannenmann | 222/481 X |
| 3,220,607 | 11/1965 | Seal | 222/652 X |
| 3,344,957 | 10/1967 | Duncan et al. | 222/651 |
| 3,402,853 | 9/1968 | Perl | 222/651 |
| 3,406,695 | 10/1968 | Perl | 222/651 X |
| 3,411,671 | 11/1968 | Harvey et al. | 222/652 |
| 3,419,190 | 12/1968 | Kauffman et al. | 222/652 |
| 3,426,944 | 2/1969 | French | 222/129 |
| 3,749,288 | 7/1973 | Wade | 222/651 X |
| 3,827,600 | 8/1974 | Janke | 222/651 |
| 3,850,185 | 11/1974 | Guth | 134/58 DL |
| 3,876,117 | 4/1975 | Wright et al. | 222/651 |
| 4,009,801 | 3/1977 | Williams | 222/651 |
| 4,149,654 | 4/1979 | Nelson et al. | 222/651 |
| 4,149,655 | 4/1979 | Nelson et al. | 222/651 |
| 4,149,656 | 4/1979 | Nelson | 222/651 |
| 4,149,657 | 4/1976 | Nelson et al. | 222/651 |
| 4,355,738 | 10/1982 | Herbst et al. | 222/129 |
| 4,488,666 | 12/1984 | Herbst et al. | 222/651 |
| 4,805,647 | 2/1989 | Marks | 134/57 D |

FOREIGN PATENT DOCUMENTS

| | | | |
|---|---|---|---|
| 1403683 | 8/1975 | United Kingdom | 134/93 |

*Primary Examiner*—Michael S. Huppert

*Attorney, Agent, or Firm*—Wood, Phillips, Mason, Recktenwald & VanSanten

[57] ABSTRACT

Dishwasher dispensing structure consisting of a reservoir for storing a supply of additive and having an outlet opening to the wash chamber, a cover movably mounted relative to the reservoir between a) a closed position wherein the cover prevents escape of additive from the reservoir outlet into the wash chamber and b) an open position permitting the reservoir outlet to be in communication with the wash chamber, a trigger mounted movably to the dishwasher between a cover block position and a cover release position, with structure on the trigger for maintaining the cover in the closed position with the trigger in its blocked position and releasing the cover to its open position with the trigger in its cover release position, a cover release member, structure driven by the timer mechanism for moving the cover release member through a first prescribed path in response to operation of the timer mechanism as the dishwasing apparatus is cycled and moving the cover release member in a first direction through a portion of the path during one portion of the operating cycle and moving the cover release member to retrace the path portion in a second direction opposite to the first direction during another portion of the cycle, trigger moving structure on the cover release member mounted for movement in a third path as the cover release member moves through the one portion of the operating cycle and in a fourth path that substantially retraces the third path as the cover release member moves in the another portion of the operating cycle.

17 Claims, 4 Drawing Sheets

FIG. 1
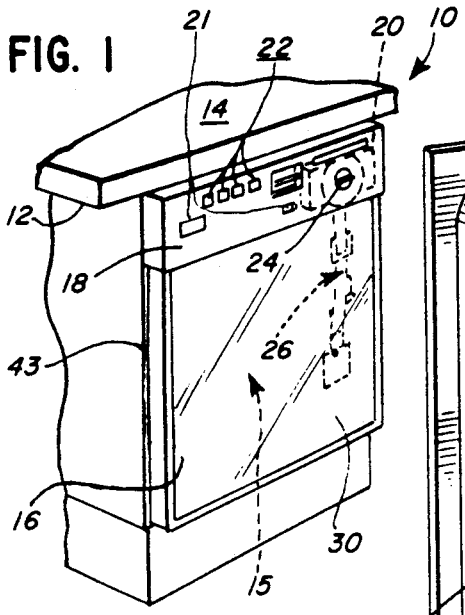
FIG. 2
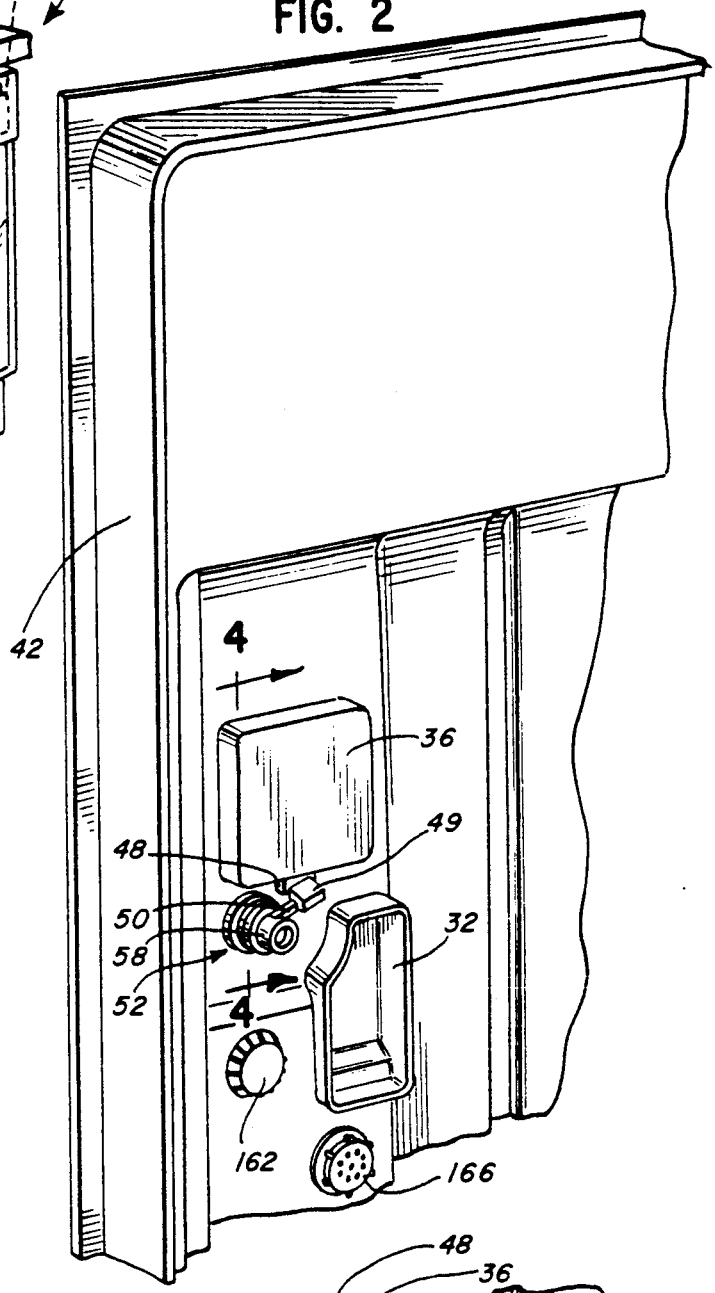
FIG. 4
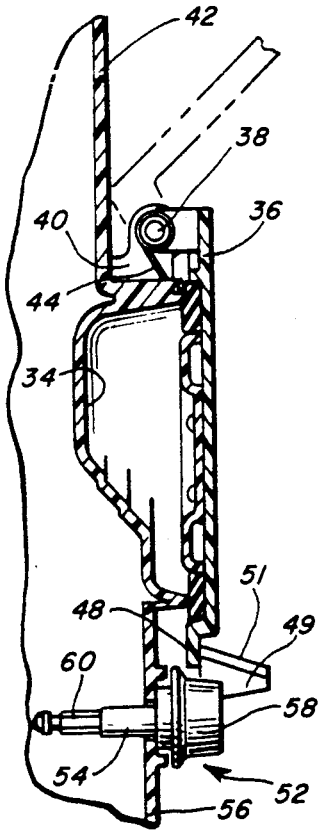
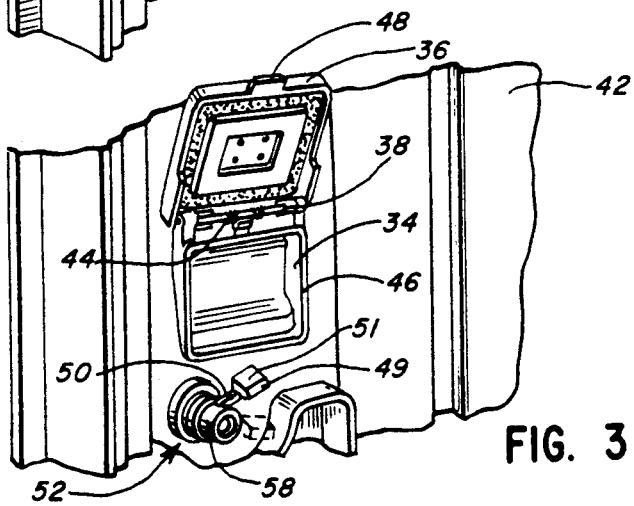
FIG. 3

FIG. 8
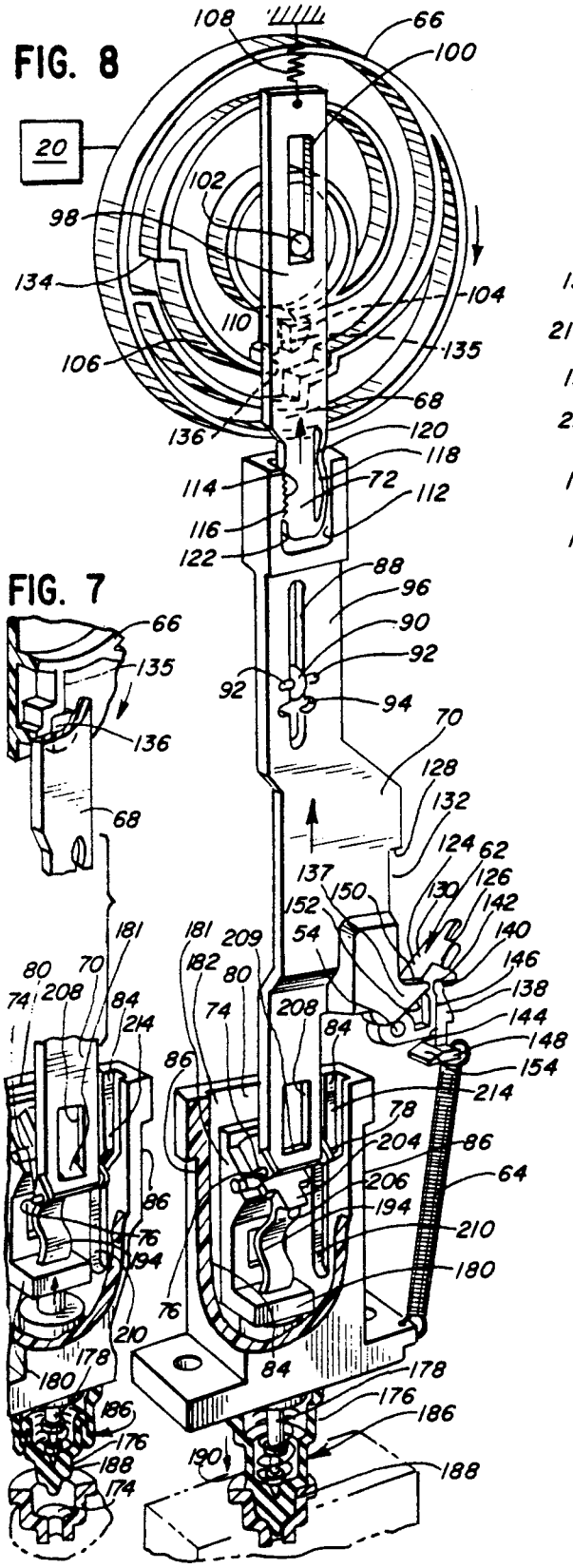
FIG. 7
FIG. 9
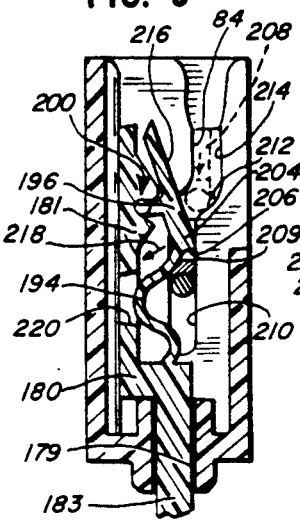
FIG. 10
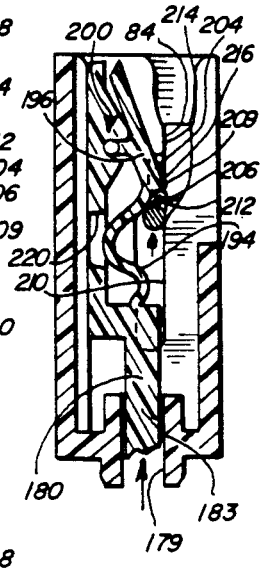
FIG. 11
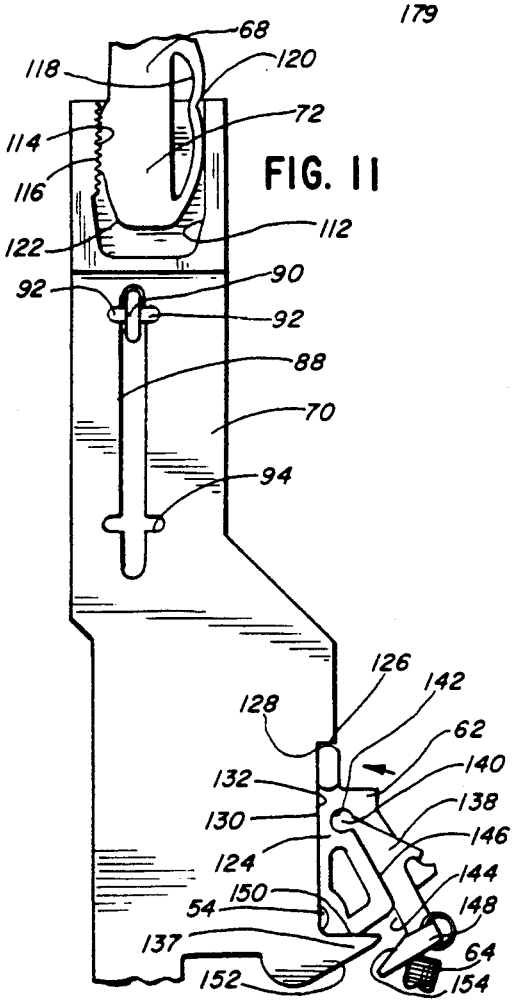

MECHANICALLY ACTUATED ADDITIVE DISPENSER FOR DISHWASHER

CROSS-REFERENCE

This is a division of application Ser. No. 250,232 filed Sept. 28, 1988, which is a continuation-in-part of application Ser. No. 900,999 filed Aug. 27, 1986 now abandoned.

BACKGROUND OF THE INVENTION

1. Field of the Invention

This invention relates to dishwashing apparatus and, more particularly, to structure for controlling the release of an additive, such as a wetting agent and liquid or powdered detergent, into a wash chamber at a predetermined stage in an operating cycle.

2. Description of the Prior Art

In prior art dishwashers, it is known to provide a reservoir for an additive and a cover for the reservoir that is movable to selectively confine the additive in the reservoir in a closed cover position and release the additive into the wash chamber in an open cover position. A timer mechanism operates through a linkage to open the cover at a predetermined stage in an operating cycle.

One of the principal drawbacks with the prior art structures has been that if operation is interrupted in mid-cycle, after the cover has opened during a wash cycle, the cover cannot be reclosed without resetting the timer mechanism. If at that stage the reservoir is refilled and the cover closed, resetting of the timer mechanism will cause the cover to open before the timer mechanism is returned to the cycle start position. The undesirable result is that the additive will be dumped into the wash chamber before the operating cycle is initiated. Alternatively, the user can open the door, manually refill the reservoir and reclose the reservoir cover after resetting the timer mechanism, which is clearly inconvenient.

SUMMARY OF THE INVENTION

The present invention is specifically directed to overcoming the above-described deficiencies in the prior art structures in a novel and simple manner.

According to the invention, structure is provided for dispensing an additive into a wash chamber of a dishwashing apparatus of the type having a timer mechanism for automatically controlling operation of the apparatus. The additive may be a wetting agent or detergent and may be in liquid or powder form. The dispensing structure consists of a reservoir for storing a supply of additive and having an outlet opening to the wash chamber, a cover movably mounted relative to the reservoir between a) a closed position wherein the cover prevents escape of additive from the reservoir outlet into the wash chamber and b) an open position permitting the reservoir outlet to be in communication with the wash chamber, a trigger mounted movably to the dishwasher between a cover block position and a cover release position, with structure on the trigger for maintaining the cover in the closed position with the trigger in its blocked position and releasing the cover to its open position with the trigger in its cover release position, a cover release member, structure driven by the timer mechanism for moving the cover release member through a first prescribed path in response to operation of the timer mechanism as the dishwashing apparatus is cycled and moving the cover release member in a first direction through a portion of the path during one portion of the operating cycle and moving the cover release member to retrace the path portion in a second direction opposite to the first direction during an other portion of the cycle, trigger moving structure associated with the cover release member mounted for movement in a third path as the cover release member moves through the one portion of the operating cycle and in a fourth path that substantially retraces the third path as the cover release member moves in the other portion of the operating cycle, and cooperating structure on the trigger moving structure and trigger a) for moving the trigger from its cover block position to its cover release position as the trigger moving structure moves in the fourth path and b) to permit the trigger moving structure to move relative to the trigger in its blocked position without moving the trigger from its blocked position as the trigger moving structure moves in the third path.

It is the principal objective of the present invention to allow the additive reservoir to be refilled after the reservoir cover has been opened during an operating cycle.

The cover is only moved out of its closed position upon the cover release member moving in the second direction and the trigger moving means traversing the fourth path. The significance of this is that at any point in the operating cycle after the cover is opened, the user may refill the reservoir and close the cover therefor. The cover will not reopen as the operating cycle is completed or the timer mechanism is manually moved through the remainder of the cycle. This prevents inadvertent, premature dumping of the reservoir in the event that the reservoir is filled mid-cycle after the cover opens.

The invention also contemplates that two such reservoirs with additive can be provided and that covers associated with both can be opened upon movement of the cover release member through its prescribed path only in one direction. For example, a detergent in powder or liquid form can be kept in one reservoir and a liquid wash additive in a separate reservoir and both can be released automatically through the inventive structure.

A further object of the invention in the case of more than one additive dispenser is to provide structure to open the covers at separate times in the operating cycle. This makes it possible to use a smaller motor than would be required if both covers were opened simultaneously.

The invention also contemplates use with different types of reservoir/cover configurations. For example, a liquid reservoir may have an outlet opening that is sealed by a cover that takes the form of a deformable plunger. Through the inventive structure, the plunger is translated between its closed and open positions. Alternatively, the cover can be a hinged door which is biased to its open position.

Regardless of the form that the cover takes, the trigger moving structure on the cover release member operates in substantially the same manner. The trigger moving structure is movably mounted relative to the cover release member and has an associated catch. The trigger moving means is guided, preferably by a pin and slot arrangement, in its third and fourth paths. The translating portion of the trigger has a deflectable arm with a surface that is, in a pull position, engageable with the catch as the catch moves to an extreme position of travel in the third path. At the extreme position of travel of the catch, the trigger surface faces the surface on the catch and is drawn thereby as the trigger moving structures moves in the fourth path to release the cover from its closed position to its open position.

At a predetermined point in the fourth path of the trigger moving means, the pin and slot arrangement causes the catch and trigger to disengage by movement of the catch surface away from the cooperating trigger surface. In the case of a pivotable door, at the point of disengagement of the catch and trigger, the door has realized its fully open position. In the case of a translatable plunger, disengagement of the catch and trigger occurs a predetermined instant after the plunger unseats. In this instant a metered amount of liquid is discharged into the wash chamber. A spring or other biasing structure urges the plunger back to its seated or closed position upon disengagement. This feature is desirable in that precise, metered amounts of liquid additive can be discharged into the wash chamber and at the same time inadvertent, uncontrolled release of the liquid additive into the wash chamber will not occur.

Accordingly, with a very simple mechanical structure, inadvertent release of the cover, upon manually resetting of the timer mechanism from mid-cycle after the release point for the dispenser cover, is prevented.

It is a further object of the present invention to make the additive dispensing structure modular in form. The modular construction facilitates both the assembly and repair processes.

More particularly, one form of module consists of a guide member, a trigger mounted to the guide member for movement in first and second opposite directions relative thereto in and out of a cover block position, structure on the trigger for permitting a reservoir cover to move from its closed position to its open position as the trigger moves out of the block position, a trigger moving element mounted to the guide member for movement relative thereto in third and fourth opposite directions, and cooperating structure on the trigger and trigger moving element (a) for moving the trigger from its block position in one of the first and second opposite directions upon the trigger moving element moving in one of the third and fourth opposite directions and (b) for permitting the trigger moving element to move relative to the trigger in its block position without moving the trigger from its block position as the trigger moving means moves in the other of the third and fourth opposite directions. The module is removably attached, as by snap-fitting structure, to the dishwasher door. Structure is provided to operatively interconnect the trigger moving element and a cover release member driven by the dishwasher timer mechanism and the trigger and a reservoir cover, with the module attached to the door.

During assembly, the module can be readily snapped into place and operatively connected with the timer mechanism and cover. If repair of any part of the module is required, the entire module can be replaced.

The invention also contemplates a module consisting of the above module construction and further having a reservoir with a cover operatively connected thereto. The first described module can be an integral part of the reservoir or, alternatively can be removably connected thereto. In either construction, the reservoir can be removably snap fit to the dishwasher door in operative relationship, wherein the reservoir outlet is in communication with the dishwasher wash chamber.

BRIEF DESCRIPTION OF THE DRAWINGS

FIG. 1 is a perspective view of a dishwashing apparatus incorporating additive dispensing structure according to the present invention;

FIG. 2 is a fragmentary perspective view of the additive dispensing structure on the inside of a door for the dishwashing apparatus and with a cover for a reservoir to contain liquid or powder additive, such as detergent, in a closed position;

FIG. 3 is a fragmentary perspective view of the detergent reservoir in FIG. 2 with the cover in an open position;

FIG. 4 is an enlarged sectional view of the detergent reservoir and associated cover taken along line 4—4 of FIG. 2;

FIG. 7 is a view similar to that in FIGS. 5 and 6 with the dispensing structure arranged to release a liquid additive, such as a wetting agent, from a second reservoir;

FIG. 8 is a view similar to that in FIGS. 5–7 after the liquid additive has been released;

FIG. 9 is an enlarged, sectional view of actuating structure for release of the liquid additive in a position prior to release thereof;

FIG. 10 is a view similar to that in FIG. 9 at the point of release of the liquid additive;

FIG. 11 is an enlarged, fragmentary, front elevation view of structure for controllably the interconnecting two elements on the dispensing structure;

FIG. 13 is a fragmentary, front elevation view of the upper portion of a modified form of additive dispensing structure on a dishwashing apparatus according to the present invention at a stage in the operating cycle prior to release of a liquid additive reservoir cover in FIG. 14 to its open position;

FIG. 14 is a section view of the additive dispensing structure along line 14–14 of FIG. 13;

FIG. 15 is a section view of the additive dispensing structure similar to that in FIG. 14 at a stage in the operating cycle wherein the liquid additive is being released into the, wash chamber;

FIG. 16 is a view similar to that in FIG. 15 at a stage in the operating cycle after the additive has been released and showing disengagement of a trigger moving structure and trigger;

FIG. 17 is a fragmentary section view of a portion of the trigger moving structure and trigger in an override position as the trigger moving structure is moved into engagement with the trigger at a stage in the operating cycle prior to reset of the mechanism;

FIG. 18 is a fragmentary, front elevation view of the lower portion of the modified additive dispensing structure where a separate reservoir is provided for an additive such as liquid or powder detergent and at a stage in the operating cycle prior to release of the detergent reservoir cover;

FIG. 19 is a section view of the detergent dispensing structure taken along line 19—19 of FIG. 18;

FIG. 20 is a view similar to that in FIG. 19 with the structure at a stage in the operating cycle wherein the cover on the detergent reservoir is open, corresponding to that in FIG. 15;

FIG. 21 is a view similar to that in FIG. 20 and corresponding to that stage in the operating cycle in FIG. 16;

FIG. 22 is a fragmentary, section view showing in solid lines the cover release member engaged with a trigger associated with the cover on the detergent additive reservoir in an override position at that stage in the cycle prior to release of the cover;

FIG. 23 is a fragmentary perspective view of the modified additive dispensing structure from the inside of the dishwasher door corresponding to the FIG. 2 view; and FIG. 24 is an enlarged, exploded perspective view of two parts making up the cover release member for the modified additive dispensing structure.

DETAILED DESCRIPTION OF THE DRAWINGS

Figure 5:
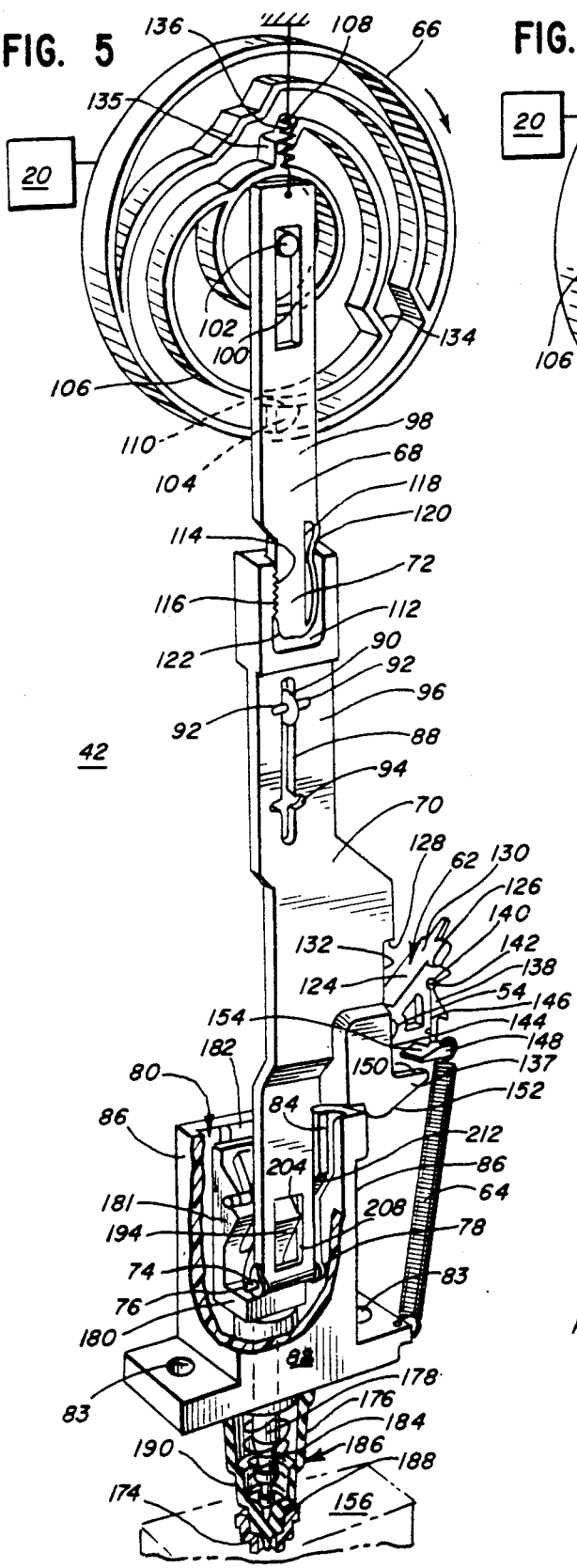
FIG. 5 is a front perspective view of the additive dispensing structure at a stage in the operating cycle prior to release of the cover for the detergent reservoir of FIG. 4.

In FIG. 1 a dishwashing apparatus suitable for the incorporation of the present invention is shown at 10. The apparatus in FIG. 1 is an under-the-counter design and is floor mounted so that the top of the apparatus 10 resides closely beneath the underside 12 of a counter 14. The present invention can be utilized in the same fashion in portable dishwashers. A wash chamber at 15 accepts a plurality of racks for supporting dishes and utensils. The wash chamber 15 has an opening at its front which is accessed through a hinged door 16, shown in FIG. 1 in its closed position. The door 16 has an associated console 18 which houses the electrical controls for the dishwashing apparatus, including a conventional timer mechanism 20. The console 18 supports operator controls 21, a vent 22 and a knob 24 through which the user can manually cycle the timer mechanism 20.

The invention is embodied in the additive dispensing structure shown generally in phantom at 26 in FIG. 1, which structure is mounted on the door 16 behind the outside front door surface 30. The operation of a conventional dishwashing apparatus typically includes alternating wash and rinse cycles followed by a dry cycle. Typically two different additives are released into the wash chamber. A detergent is mixed in the chamber 15 during separate wash cycles and a rinse aid additive releases in a rinse cycle late in the operating cycle to prevent formation of water stains on the dishes and utensils as they dry.

As seen in FIGS. 2–4, the detergent is contained in two separate reservoirs 32, 34. The reservoirs 32, 34 and a mounting base 40 are integrally formed with a plastic liner 42 that is fit on the inside door surface 43 and faces inwardly toward the chamber 15. Reservoir 32 is always open to the wash chamber while reservoir 34 has an associated cover 36 that is hinged about a pin 38 mounted in base 40 for movement between a closed position shown in FIG. 2, wherein the cover 36 seals the reservoir 34, and an open position, shown in FIG. 3, wherein the door pivots so that the reservoir 34 is in open communication with the wash chamber 15. The cover position is automatically controlled by structure hereafter described.

Before the user starts the apparatus 10, both reservoirs 32, 34 are filled with a supply of detergent. The cover 36, which is normally biased to its open position by a coil spring 44, is moved manually against the spring bias to the closed position in FIG. 2, wherein it covers the reservoir 34 and bears on the peripheral edge 46 about the reservoir 34. The cover 36 has an associated offset tab 48, which can be engaged by an enlarged head 49 having an inclined surface 51 at the free end of a pivotable latch arm 50 so that the head 49 blocks the cover 36 in its closed position.

The latch arm 50 is part of a pivotable latch assembly 52. The latch assembly 52 has a shaft 54, which extends through the wall 56 of the liner. The shaft 54 makes keyed connection inside the door with a body 58, from which the latch arm 50 projects and has a splined portion 60 inside the door between the liner and front surface 30, which is splined to a lever 62 (FIGS. 5, 6, 8 and 11). Alternatively, the shaft 54 is molded to the body 58. As seen in FIGS. 5, 6, 8 and 11 and more fully described below, the lever 62 is biased by a coil spring 64 which urges the latch arm 50 in a counterclockwise direction in FIG. 2.

To lock the cover 36, the arm 50 is rotated clockwise in FIG. 2 by the action of tab 48 against inclined surface 51 as the cover 36 is rotated to its closed position sufficiently to allow clearance of the tab 48. With the cover 36 in its fully seated and closed position, the arm 50 passes tab 48 and is released so that the bias in spring 64 overtakes the arm and shifts it blockingly across the tab 48. To release the cover 36, the arm 50 must be pivoted against the bias of spring 64 downwardly to the position shown in phantom in FIG. 3 and, as this occurs, the cover will pivot open under the force of spring 44 to expose the inside of the reservoir 34 to the wash chamber 15. The first wash cycle uses the detergent in reservoir 32. A later wash cycle uses the detergent in reservoir 34 upon the cover 36 being released, which is accomplished automatically by the dispensing structure at 26, shown in detail in FIGS. 5–11, as dictated by the controlling timer mechanism 20.

Referring now to FIGS. 5–11, in which the inventive structure is detailed, it can be seen that the dispensing structure comprises generally a rotatable control cam 66, an associated cam follower 68 and an actuating member 70 which is joinable with the bottom free end 72 of the cam follower 68 as hereafter described. The cam follower 68 and actuating member 70 are preferably formed of plastic and cooperatively define an elongate link that is movable longitudinally thereof upon rotation of the control cam 66 which is driven by the timer through a drive pin 102 as the dishwashing apparatus is cycled by the timer mechanism 20 shown schematically in each of FIGS. 5, 6 and 8.

Figure 12:
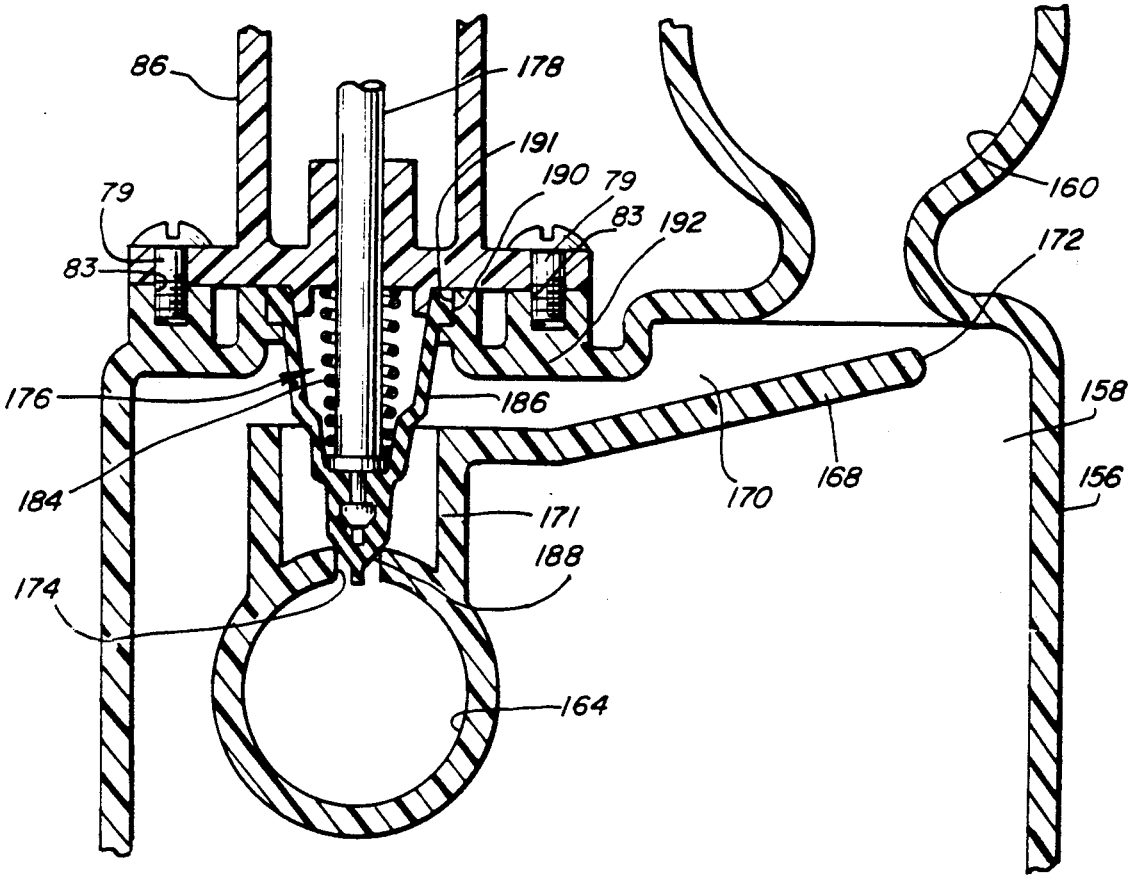
FIG. 12 is a section view of a reservoir for containing a liquid additive.

At its lower end, the actuating member 70 mounts a pin 74 having oppositely projecting free ends 76, 78, which are admitted through the open end 80 of a support block 82 (FIG. 12) mounted on a container 156 (FIG. 12), described below, by conventional means such as screws 79 (FIG. 12) extending through openings 83 in the block 82. The ends 76, 78 fit into spaced guide slots 84, which are formed in lateral block walls 86 and open towards each other. At the upper region of the actuating member 70, a T-shaped slot 88 having a cross bar 94 is defined. The liner 42 has an associated disk-shaped projection 90 with lugs 92 projecting in opposite directions from the faces thereof.

To assemble the actuating member 70, the pin ends 76, 78 are first introduced to the slots 84 and the member 70 is moved sufficiently downwardly to align the lugs 92 with the cross bar 94 of the T-shaped slot 88. With the lugs 92 directed entirely through the slot, the actuating member 70 can be shifted downwardly so that the lugs 92 overlie the forwardly facing surface 96 of the actuating member 70 and thereby confine forward tilting of the upper portion of the member 70 relative to the liner 42.

The cam follower 68 has an elongate body 98, defining a lengthwise rectangular slot 100, which accepts timer shaft 102 projecting forwardly of the door from a motor (not shown). The shaft 102 guides vertical movement of the cam follower 68 and rotates the cam 66. The cam follower 68 has a rearwardly projecting guide lug 104 which traverses the three step, cam surface 106 on the control cam 66. The cam follower 68 is biased upwardly by a coil spring 108 so that an upwardly facing guide surface 110 on the lug 104 maintains intimate contact with the cam surface 106 and the cam follower 68 responds positively and consistently to the movement of the control cam 66.

The upper region of the actuating member 70 defines an upwardly opening, rectangular recess 112 with an integrally formed row of teeth 114 extending lengthwise of the member 70 at one side of the recess 112. The cam follower 68 has at its lower free end a lengthwise row of teeth 116 for cooperation with the teeth 114 on the actuating member 70. The lower portion of the cam follower has a weakening cut-out 118 which defines a flexible side 120 that is collapsible into the cut-out 118 to effectively narrow the width of the cam follower 68 at its bottom portion. The bottom of the cam follower has a rounded leading edge 122 for guiding the cam follower into the recess 112 in the member 70.

By moving the cam follower 68 and member 70 towards each other in a longitudinal direction, with the lower portion of the cam follower introduced to the recess 112, the teeth progressively engage to prevent separation of the cam follower and member 70. Because the lower end of the cam follower 68 is slightly wider than the width of the recess 112, the side 120 will collapse into the cut-out 118 and thereby exert a bias on the row of teeth 116 on the cam follower toward the row of teeth 114 on the member 70. As the cam follower and member 70 are urged longitudinally towards each other, the teeth engage and ride over each other which is made possible by a slight lateral shifting of the cam follower against the bias established by the side 120. The cooperating rows of teeth 112, 114, make it possible for the cam follower 68 and member 70 to be locked relative to each other in a plurality of longitudinal positions as dictated by the number and spacing of teeth.

The lever 62 is used to establish a desired relationship between the cam follower and member 70. The lever 62 has an associated arm 124 with a surface 126 at its free end that can be disposed beneath a downwardly facing shoulder 128 on the member 70. The surface 126 is placed in the path of the shoulder by pivoting the lever 62 about the lever shaft 54 in a counterclockwise direction, until, as shown in FIG. 11, a flat surface 130 on the arm 124 facially encounters a laterally facing surface 132 on the actuating member 70. The actuating member 70 can be shifted downwardly with the surfaces 130, 132 against each other until the surface 126 and shoulder 128 abut, at which point further downward shifting of the actuating member 70 is arrested.

With the cam follower 68 in operative relationship with the control cam 66 and the free end of the cam follower introduced at the top of the recess 112, the cam 66 can be manually rotated by rotating the timer with the knob 24 through a complete operating cycle. The rows of teeth 114, 116 will progressively increase in overlap until the extreme downward travel position of the cam follower is realized. The combined length of the cam follower 68 and actuating member 70 can be precisely established by the assembler and connection involves only the simple steps of pivoting the lever 62 to abut the actuating member 70 and thereafter manually cycling the control cam 66. Not only does this assure consistent, predetermined relationship between the actuating member and cam follower, but it also assures that undue stress is not transmitted through the linkage between the timer mechanism 20 and lever 62 during assembly and operation. After the actuating member 70 reaches its downwardmost travel position, it will be drawn upwardly and, as this occurs, the bias of spring 64 will urge the lever 62 to its normal position in a clockwise direction from that shown in FIG. 11.

To facilitate separation of the cam follower 68 and actuating member 70, the front side of the recess 112 is open. This permits the cam follower to be drawn rearwardly of the door to separate the teeth on the cam follower and actuating member and obviates having to force the teeth on the cam follower over the teeth on the actuating member by moving the cam follower 68 and actuating member 70 longitudinally away from each other.

It can be seen that the contour of cam surface 106 causes joined cam follower 68 and actuating member 70 to follow a reciprocating path as the apparatus is cycled. The cam follower 68 is urged progressively downwardly from its FIG. 8 position as the cam rotates clockwise in FIG. 8. The extreme downward position of the cam follower is achieved with the lug at the position immediately adjacent the first cam step 134 (FIG. 5). A second cam step 136 moves the cam follower from an intermediate position to its FIG. 8 position upon continued rotation of the cam.

Operation of the detergent door latch in response to movement of the cam follower 68 and actuating member 70 is accomplished through the cooperation of a lateral projection 137 on the actuating member 70 with a trigger arm 138 associated with the lever 62. The trigger arm 138 has a cylindrical portion 140 which snaps into a cylindrical slot 142 on the lever so that the trigger arm 138 pivots about an axis substantially parallel to but spaced from the axis of pivoting of the shaft 54. The trigger arm 138 has a laterally projecting, flat surface 144 which is borne by the force of spring 64, connected between the trigger arm 138 and support block 82, facially against a laterally facing surface 146 on the lever 62. This imparts the aforementioned bias to the lever 62 in the clockwise direction in FIGS. 5, 6, 8 and 11.

The free end of the trigger arm 138 has an enlarged head 148 which projects towards the front of the dishwasher into the path of movement of the lateral projection 137 of the actuating member 70. Upon the actuating member 70 moving from its FIG. 5 position towards a later wash cycle, the member 70 moves upwardly at cam surface 134 and bears an upwardly directed edge 150 against the underside of the enlarged head 148 of the trigger arm, thereby causing a counterclockwise rotation to be imparted to the lever 62 and as an incident thereof the latch arm 50 pivots from its FIG. 3 position to the position shown in phantom in FIG. 3 so that the cover 36 is released and moves to an open position in preparation for the subsequent wash cycle. Continued operation of the timer mechanism causes the projection 137 to pass vertically upwardly beyond the enlarged head 148 of the trigger arm 138 to generally the position shown in FIG. 11, at which point the spring 64 draws the trigger arm and lever 62 clockwise from its position shown generally in FIG. 11 to its position in FIGS. 5, 6 and 8.

Sometimes, a user may interrupt operation of the dishwashing apparatus in mid-cycle after the cover 36 is opened during the wash cycle. For example, with the dispensing structure in the FIG. 8 position, a user may manually reset the timer mechanism 20. This involves moving the cam follower and associated actuating mechanism from the FIG. 8 position to the FIG. 5 position. This can be accomplished with the inventive structure without having to reset the cover 36 and is made possible by the connection of the trigger arm 138 with the lever 62.

According to the invention, the trigger arm 138 is rotatable counterclockwise in FIGS. 5, 6, 8 and 11 relative to the lever against only the resistance developed by spring 64. As the bottom edge 152 of the lateral projection 137 encounters the head 148 of the trigger arm, the trigger arm pivots sufficiently to allow the part 137 to go downwardly beyond the trigger arm without pivoting the lever 62. To facilitate deflection of the trigger arm, the bottomedge 152 is inclined in the same direction as an upwardly facing surface 154 at the free end of the trigger arm. The bottom edge 152 of the part 137 progressively deflects the trigger arm in a counterclockwise, rotative path until clearance is made. Accordingly, after the cover 36 is opened during the operating cycle, the user is given the freedom of manually moving the actuating member downwardly past the trigger arm without having to reclose the cover 36 over the reservoir 34. This prevents inadvertent release of detergent in reservoir 34 into the wash chamber prior to a subsequent wash cycle.

The cam follower 68 and actuating member 70 are also responsible for releasing a rinse aid additive into the wash chamber at a prescribed stage in the operating cycle. The rinse additive is distributed in the wash chamber during a rinsing cycle and minimizes adherence of residue on the dishes as they dry after being rinsed. A container 156 (FIGS. 5, 6 and 12) has an internal chamber 158 for retaining a supply of the liquid rinse aid. The container 156 is mounted inside the door and has a conduit 160 directed through the inside wall 56 of the liner. The conduit 160 communicates with the chamber 158 and is accessible through the rear side of the plastic liner with the door open. A cap 162 (FIG. 2) is screw threaded to and seals the conduit. Also projecting through the liner wall 56 is a discharge conduit 164 with an associated porous cap 166 (FIG. 2).

To control the size of the charge delivered to the wash chamber 15, the chamber 158 has a baffle 168 which partially encloses a flow directing baffle 168 defining a collecting area 170 and a metering cavity 171. With the door moved to its open horizontal position, liquid from chamber 158 finds its way around the free end 172 of the baffle 168 and into the area 170. The metering cavity is recharged each time the door is opened. Upon returning the door to its vertical position, the bulk of liquid flows gravitationally to the bottom of the container 156 while a charge is trapped by the baffle in the cavity 171. The metering cavity 171 communicates with the conduit 164 through a port 174. Discharge of the liquid from the metering cavity 171 through the port 174 and cap 166 is controlled by a plunger 176, which is moved upwardly to allow the rinse additive to discharge by gravity into the wash chamber 15. At a predetermined stage in the operating cycle, a charge of rinse aid is delivered from the metering cavity 171 through the ca 166 into the wash chamber 15.

The rinse aid dispensing mechanism is detailed in FIGS. 5–10 and 11. The plunger 176 has an internal control stem 178 which is part of a control element 180 which slides guidingly upwardly and downwardly in a recess 182 in the block 82. The element 180 is guided principally by an associated leg 183 connecting the stem 178 and body 181 of the element 180. The leg moves vertically in a channel 179 defined by the block 82 and closely matched to the cross section of the leg 183. A coil spring 184 biases the plunger and associated control element 180 downwardly into sealing engagement with the port 174 as shown in FIGS. 5, 6, 8 and 12. The plunger has a stepped outer surface 186, with the port 174 sealed by a first diameter portion 188. A larger diameter portion 190 (FIG. 12) seals an opening 191 in the upper wall 192 of the container 156. With the plunger in its downwardmost position, the port 174 is sealed by the plunger. Upward movement of the plunger opens the port allowing vented circulation of the liquid from the metering cavity 171 into the wash chamber 15.

Referring to FIGS. 9 and 10, the control element 180 has a collapsible, serpentine, trigger section 194 extending between the leg 183 and body 181. The upper portion of section 194 is hingedly connected to the body at 200. The section 194 is enlarged at its upper region 196 and defines a rearward projection 204 having a downwardly facing shoulder 206. The projection 204 is received in a rectangular opening 208 (FIG. 7) having a lower surface 209 in the bottom portion of the actuating member 70. The opening allows a limited amount of relative vertical shifting between the projection 204 and actuating arm 70.

Before the actuating member 70 is assembled, the guide element 180 rests in the FIG. 9 position, being drawn downwardly by the coil spring 184. In the FIG. 9 position, the projection 204 and shoulder 206 reside in the path of the pin 74, which moves in the slots 84. The slots 84, as seen clearly in FIGS. 9 and 10, each comprise a lower vertically extending portion 210, an offset portion 212 slightly above the projection 204 in the FIG. 9 position and a second vertically extending portion 214 above the offset portion 212.

With the pin free ends 76, 78 in the slots 84 and the actuating member moved downwardly during assembly (shown in phantom in FIG. 9), the pin 74 traversing the offset portion 212 of the slot encounters an angled surface 216 on the enlarged portion 196. Further downward movement of the actuating member 70 deflects a portion of the section 194 in the direction of arrow 218 in FIG. 9 forwardly into a recess 220 in the guide element 180. Upon continued downward movement of the actuating member, the lower surface 209 of opening 208 clears the projection 204 and allows the collapsible section 194 to reassume its FIG. 9 position. In the FIG. 9 position, the shoulder 206 blocks against surface 209 to prevent upward movement of pin 76 so that the pin 74 is effectively captured therein. With the actuating member 70 so positioned, the projection 204 extends through the opening 208 and thereby guides relative vertical movement of the guide element 180 and actuating member 70.

A charge of the rinse aid additive is released upon the actuating member moving upwardly and thereby drawing with it the guide element and plunger. As shown in FIG. 10, the surface 209 bears upwardly against the shoulder 206 as the actuating member rises and shifts the guide element 180 upwardly. This occurs as the guide lug 104 approaches the second step 136 on the cam 66. As the pin 74 reaches the offset portion 212 of the slot, drawing with it the guide element 80, the pin 74 will shift outwardly into the offset simultaneously as the lug 104 moves upwardly at third offset 135 to its FIG. 8 position. Movement of the guide element 180 upwardly to the point of separation draws the plunger upwardly sufficiently to release the rinse aid liquid into the wash chamber. Upon the pin and thus surface 209 clearing the projection 204 when lug 104 reaches offset 135, the coil spring 184 draws the guide element downwardly so as to bring the plunger into sealing engagement with the container.

A short summary of the operation of the dispenser mechanism is as follows. At the beginning of the dishwasher cycle the cam 66 and follower 68 are in the positions shown in FIG. 5. As the cam rotates in the clockwise direction driven by the timer 20 the lug 104 of cam follower 68 travels against surface 106 of the cam 66. When the rotation of the cam brings the follower to the first step 106 the bias of spring 108 rapidly moves the cam follower upward forcing the projection 137 against the enlarged head 148 which rotates latch arm 50 so that head 49 unblocks the cover 36. The cover is rotated by the spring 38 to the open position such that the detergent contents of the cup 34 are free to be washed from the cup by water within the washing chamber. The cam 66 is now in the position shown in FIG. 6 and as it continues its rotation the lug 104 approaches the second step 136. When the lug 104 reaches the step 136 the cam follower and lever 70 are pulled upward with surface 209 pulling projection 204 upward. Movement upward of the projection 204 lifts the plunger 176 from its seat allowing rinse additive in the metering cavity 171 to flow into the dishwashing chamber. As the cam 66 continues further rotation, the lug 104 reaches the third step in the cam 135. At this point cam follower 68 and member 170 move upwardly again to their uppermost position moving surface 209 past projection 204 and allowing the force of spring 184 to return the plunger 176 to its seated position. Further rotation of cam 66 through the remainder of the cycle brings the lug 104 in cam follower 68 back to the position of FIG. 5. During this travel of cam 66 the follower 68 moves downward such that projection 137 is forced past enlarged head 148 and surface 209 is forced past projection 206. The dispenser actuating mechanism is now in position to repeat the actuation cycle. If for any reason, after the operation of the detergent dispenser cover to its open position, the operator should manually rotate the timer mechanism it will be noted that the steps 136 and 135 are closely adjacent each other such that during manual rotation the plunger 176 would be raised and lowered from its seat in rapid succession such that only a small amount of rinse aid would be allowed to exit the metering cavity 171. Thus, even though the timer would be manually rotated to its starting position, and the door not opened sufficiently to recharge the metering chamber, there would be sufficient rinse aid left in the chamber 171 to provide rinse aid at the proper point in the cycle to perform the rinse aid function. The described arrangement also avoids inadvertent dispensing of the rinse aid if the dishwasher door is opened and closed during the dry cycle.

It can be seen that the container is positively sealed by the plunger and that the snap-fit engagement of the collapsible section 194 and actuating member can be accomplished without releasing a charge of the liquid additive. Movement of the actuating member downwardly through the operating cycle will effect engagement of the actuating member 70 and guide element 180 without releasing rinse aid additive, while movement of the actuating member upwardly releases the plunger for a sufficient time to discharge the additive into the wash chamber.

An alternative embodiment of the invention is disclosed in FIGS. 13–24. In FIGS. 13–17, a liquid additive reservoir is shown at 310 and corresponds to the container 156 in the previously described embodiment. The modified form of the invention depicted in FIGS. 13–17 has a slightly different configuration for the reservoir 310 and the associated structure for causing controlled dispensing of the supply of liquid additive in the reservoir 310. In FIGS. 18–22, modified structure for controllably discharging detergent additive from a reservoir 312, corresponding to the reservoir 34 in the previously described embodiment, is shown. As seen clearly in FIG. 23, in the modified version, the reservoirs 310, 312 are inverted from the positions the corresponding reservoirs 156, 34 occupy in the embodiment in FIGS. 1–12.

Dispensing of liquid from reservoir 310 and detergent, which can be liquid or powder, from reservoir 312, is controlled by a mechanism shown at 314 in FIGS. 13 and 14. The control mechanism 314, as in the prior embodiment, consists of a motor/timer 316 with a rotatable shaft 318 that moves a control cam 320, similar to the cam 66 in the previously described embodiment. The control cam 320 has inner and outer guide surfaces 322, 324 respectively, that cooperatively guide translation of a pin 326 and, as an incident thereof, move a cam follower 328 bearing the pin 326 in a prescribed, linear path. The cam follower 328 is moved in a downward path through part of the operating cycle and retraces the path upwardly through another part of the operating cycle. The cam follower 328 is guided in its a vertical reciprocating path by the cooperative arrangement of the shaft 318 and an elongate, vertical slot 330 in the cam follower 328. Through one complete operating cycle, the cam follower 328 moves from a starting position, wherein the shaft 318 nests in the bottom of slot 332, back up to the FIG. 13 position, and returns to the starting position. The cam follower 328 moves in stepwise fashion due to the cam configuration, as previously described.

The operation of the inventive structure will first be described with respect to the liquid additive reservoir 310, as shown in FIGS. 13–17. A supply of liquid additive is introduced to the reservoir 310 through an opening 334 in the door liner 336. A removable cap 338 is used to selectively seal the opening 334. The reservoir 310 has a metering chamber 340 at its upper region. Upon the appliance door 16 being pivoted to its open position, additive flows from the main chamber 342 of the reservoir 310 by gravity through a restricted opening 344 into the metering chamber 340. The metering chamber 340 communicates through an outlet 346 into a recessed drip chamber 348 within which the cap 338 resides. The cap 338 has a plurality of ribs 349 (FIG. 15) between which the additive that is delivered to the drip chamber 348 bleeds out into the wash chamber.

The outlet 346 is selectively sealed by a resilient cover 350, which is a plunger having a stepped configuration. A trigger at 352 has a head 354 embedded in the lower portion of the cover/plunger 350. The trigger 352 has an elongate body 356 with vertically spaced, integrally formed pairs of guide pins 358. The guide pins 358 project in opposite directions from the body 356 and are received and guided in slots/tracks 360 in a guide member 361. The trigger 352 is translatable between a block position in FIG. 14 to a release position in FIG. 15. In the FIG. 14 block position, the coil spring 372 urges the trigger 352 downwardly and the cover/-plunger 350 into a closed/sealing position, wherein the stepped outer surface 362 of the cover/plunger 350 nests in a seat 364 surrounding the outlet 346 defined in a wall 366 between the metering and drip chambers 340, 348 respectively. In the FIG. 15 release position, the cover/plunger surface 362 is moved away from the seat 364 to define a flow passageway 368 for communication of the additive in the direction of arrow 370 into the drip chamber 348.

The trigger 352 and the cover/plunger 350 carried thereby are normally biased into the FIG. 14 position by the coil spring 372, surrounding a stem 374 on the trigger 352 and interposed between a wall 376 on the reservoir 310 and a thickened portion 378 of the cover/-plunger 350. In the FIG. 15 position for the cover/-plunger 350, the peripheral wall 380 of the cover/-plunger 350 is collapsed upon itself.

To operate the cover/plunger 350 during an operating cycle, a trigger moving member 382 is provided and operatively associated with a cover release link/member 384 connected to the cam follower 328 through cooperating rows of teeth 386, similar to those in the previously described embodiment. The teeth 386 in this embodiment are interengaged as cam follower 328 is drawn upwardly relative to the cover release link-/member 384, whereas in the first embodiment the corresponding connection is effected by downward movement of the cam follower 68. The link 384 has an elongate guide slot 388 which cooperates with a lug 390 on guide member 361 to guide vertical translatory, reciprocating movement of the link 384.

The trigger moving member 382 has a body 392 with vertically spaced pin pairs 394, 396, with each pin pair 394, 396 consisting of pins projecting oppositely from the body 392. Spaced slots/tracks 398 receive and vertically guide the pin pairs 394, 396, which are introduced at an open end 400 of each slot 398 in the guide member 361. Each slot 398 consists of a first vertical leg 402, an offset leg 404, and a second vertical leg 406.

The link 384 has an integral, projecting drawing arm 408 which extends into an opening 410 in the body 392. As the link 384 translates vertically, the arm 408 causes the trigger moving member 382 to follow. Upward vertical movement of the link 384 from the FIG. 14 position draws the trigger moving member 382 upwardly. As this occurs, an upwardly facing surface 412 of a catch 414 on the member 382 intercepts a downwardly facing surface 416 on a pull arm 418 on the trigger 352. Continued upward movement of the trigger moving member 382 causes the trigger 352 to be moved against the bias of spring 372 upwardly to the open position (FIG. 15) for the cover/plunger 350, thereby permitting the additive to bleed by gravity from the metering chamber 340 to the drip chamber 348 and into the wash chamber 15. It can be seen in FIG. 15 that with the cover/plunger 35 fully open, the lower pin pair 396 on the trigger moving member body 392 resides at the juncture of the vertical slot legs 406 and offset slot legs 404. Continued upward movement of the linkage 384 causes the pin pair 396 to be guided from right to left in FIG. 15 in the offset slot legs 404 so that the catch 414 separates from the surface 416 on the pull arm 418. At the point of disengagement, the spring 372 drives the cover/plunger 350 back into its closed position, as shown in FIG. 16.

Upon the link 384 travelling during an operating cycle in a downward direction from its FIG. 16 position to an override position, a downwardly facing, inclined ramp surface 420 on the catch 414 encounters a forwardly facing surface 422 on the pull arm 418. As further downward movement of the link 384 occurs, the pin pair 396 moving in the offset slot legs 404 causes the catch 414 to be urged towards the right in FIG. 16, thereby bending the free end 424 of the pull arm 418, which is supported in cantilever fashion, as shown in FIG. 17. The pull arm 418 is made sufficiently flexible to permit the deformation required to move the catch 414 against and past the pull arm free end 424, but is rigid enough and so oriented to transmit a lifting force from the catch 414 to the trigger 352 as the link 384 is moved upwardly from the FIG. 14 position. As the catch 414 is moved downwardly from the FIG. 17 position sufficiently to clear the free end 424 of the pull arm 418, the free end 424 springs back to its undeformed state, as shown in FIG. 14.

It can be seen that in operation the trigger moving member 382 following the link 384 moves the trigger 352 upwardly to unseat the cover/plunger 350 and in an instant is disengaged from the trigger 352 to allow the trigger 352 to be driven back downwardly under the force of spring 372 to seat the cover/plunger 350 in closed position at the reservoir outlet 346.

The additive dispensing structure for the detergent reservoir 312 works much the same as the structure associated with reservoir 310 for the rinse aid, and its operation is clearly seen in FIGS. 18-22. The reservoir 312 is integrally formed with the door liner 336 as a depression in the rearwardly facing wall 426 thereof. The reservoir 312 has a peripheral edge 428 which seats a cover/door 430 mounted to the door liner 336 for pivoting movement about axis 432 between a closed position, shown in FIG. 19, and an open position in FIG. 20. In the open position for the cover 430, a supply of liquid or powdered detergent 434 within the reservoir 312 can escape through the outlet opening 436 of the reservoir 312, into the wash chamber. A coil spring 438 normally biases the cover 430 to its open position in FIG. 20.

The reservoir cover 430 has an associated trigger at 440. The trigger 440 has a first part 442 mounted to the liner 336 for pivoting movement about an axis 444 between a cover block position in FIG. 19, wherein a catch 446 on the trigger part 442 blocks the cover 430 in its closed position, and a release position, shown in FIG. 20, wherein the catch 446 is pivoted clockwise from the FIG. 19 position about axis 444 to allow the cover 430 to pivot in the direction of arrow 448 from its closed position, to its open position.

The trigger 440 has a second part 450 that translates in a vertical reciprocating path, in response to a like movement of the link 384, to pivot the first trigger part 442 between its block and release positions. The first trigger part 442 has a stem 452 which extends through an opening 454 defined by the second trigger part 450. The second trigger part 450 has a body 456 with an upper pin pair 458 projecting oppositely therefrom and a lower pin pair (not shown), projecting from the body 456 in like fashion. The pin pairs 458 guide vertical movement of the trigger part 450 in spaced, vertical slots/tracks 459 in guide member 457. Upward movement of the trigger part 450 pivots the first trigger part 442 through the stem 452 in a clockwise direction about axis 444 so that the catch 446 on the trigger part 442 is in the cover release position.

The trigger 440 is moved from its cover block position to its cover release position by a trigger moving member 460, corresponding to the aforementioned trigger moving member 382 associated with the reservoir 310. The trigger moving member 460 has a body 462 with vertically spaced pairs of pins 464, 466 projecting oppositely therefrom at the top and bottom portion, respectively, of the trigger moving member body 462. The trigger moving member 460 has an opening 468 to receive a drawing arm 470 on the link 384.

The pin pairs 464, 466 on the trigger moving member body 462 are guided in the same slot 459 as the trigger part 450 is guided. Each slot 459 has a vertical leg 472, an offset leg 474, a second vertical leg 476, a return offset leg 478 and a third vertical leg 480 having an open end 482 into which the pin pairs 464, 466 are introduced to the slot 459.

As the link 384 moves upwardly during an operating cycle from the FIG. 19 drawing position, through arm 470 it draws the trigger moving member 460 upwardly. The trigger moving member 460 has a catch 484 with an upwardly facing surface 486 that engages a downwardly facing surface 488 at the free end 490 of a flexible pull arm 492 on the trigger part 450. The catch 484 draws the trigger part 450 upwardly through the pull arm 492, thereby pivoting the first trigger part 442 to release the cover 430, until the pin pair 466 arrives at the offset slot legs 478. At that time, the slot legs 474 deflect the pins 466 so as to cause the bottom portion of the trigger moving member 460 to be pivoted from right to left in FIG. 20 until the catch 484 and pull arm 492 disengage, as shown in FIG. 21.

Upon disengagement of the catch 484 and pull arm 492, the trigger 440 is biased to its cover block position by a coil spring 494, which surrounds a stem 496 at the bottom of the trigger part 450 and is interposed between a wall 498 on the guide member 457 and an enlarged head 500 at the free end of the trigger stem 496.

As the link 384 is moved downwardly from the FIG. 21 position, a ramp surface 502 on the catch 484 bends the free end 490 of the pull arm 492 progressively to the phantom position in FIG. 22 as the trigger moving member 460 is guided through the pin pair 466 in slot 459 towards the right in FIG. 22. Once the catch 484 bends downwardly sufficiently to clear the pull arm free end 490, the pull arm 492 can spring back to its undeformed position shown in FIG. 19.

The cover 430 is readily closed, once the reservoir 312 is filled, by urging the cover 430 forwardly against the catch 446. The catch 446 has a ramp surface 514, which upon encountering a lip 516 on the cover 430, causes the trigger part 442 to be progressively urged in a clockwise direction about pivot axis 444. With the cover 430 fully closed, the catch 446 springs back to engage the cover lip 516 and thereby maintain the cover 430 in its closed position.

The link 384, as seen in FIGS. 13, 14, 15, 16, 18–21 and 24, consists of cooperating upper and lower link halves 550, 552, respectively. The link halves 550, 552 are guided for vertical translatory movement relative to each other between the operative phantom position in FIG. 24, wherein two upwardly facing shoulders 554, 556 on the lower link half 552 abut downwardly facing shoulders 558, 560, respectively, on the upper link half 550, and a separated position, wherein the link halves 550, 552 are moved vertically away from each other and their operative position. Movement of the upper portion 562 of the lower link half 552 relative to the upper link half 550 is guided in part by six tabs 564 and a cross bar 566 on the upper link half 550, which cooperatively define a vertical slide path for the lower link half 552.

The lower link half 552 is also guided by the lug 390 on guide member 361, which lug moves in the slot 388 in the lower link half 552. The lower link half 552 is further guided by a lug 568 (FIG. 18), which moves in a second vertical slot 570 in the lower link half 552.

The lower link half 552 is urged upwardly relative to the upper link half 550 towards its operative position by a coil spring 572 which has its upper end 574 secured to a lug 576 on the reservoir 310 and its lower end 578 secured to a lug 580 on the lower link half 552. The spring 572 is kept under sufficient tension that the link halves 550, 552, in operation, move as a unit.

The two-part construction for the link 384 is provided to prevent jamming of the dispensing structure as the teeth 386 on the cam follower 328 and upper half 550 of link 384 are engaged. To effect this assembly, the link 384 is placed against the liner 336 so that the lugs 390, 568 are directed through correspondingly configured, enlarged openings 582, 584, respectively, in the lower link half 552 and contiguous with the slots 388, 570, respectively. The cam follower 328 is placed over the motor shaft 318 and the lower free end 586 of the cam follower 328 is situated in the opening 588 at the top of the upper link half 550, so that the teeth 590 on the cam follower 328 are in vertical alignment with the teeth 592 on the upper link half 550 with which they cooperate.

Upward movement of the cam follower 328 through operation of the timer mechanism causes the teeth 590, 592 to progressively intermesh. As intermeshing of teeth is proceeding, the cam follower 328 draws the link half 550 upwardly with it until upwardly facing shoulders 594, 596 thereon engage downwardly facing shoulders 598, 600, respectively, on stop members 602, 604, respectively, on the liner 336. The teeth 590, 592 will releasably lock at the upwardmost point of travel of the cam follower 328.

If the dispensing structure actuated by the drawing arm 470 on the lower link half 552 is for any reason jammed, the spring 572 will stretch to permit relative movement between the link halves 550, 552 and engagement of the teeth 590, 592 With the cam follower 328 and link half 550 in proper registration, without damage to the mechanism.

The invention also comprehends that the dispensing mechanism associated with the covers 350, 430 be so arranged that the covers 350, 430 are not opened simultaneously in operation. The result is that a smaller operating motor is can be used than would be necessary to operate a mechanism to release both covers 350, 430 at the same time.

Figure 6:
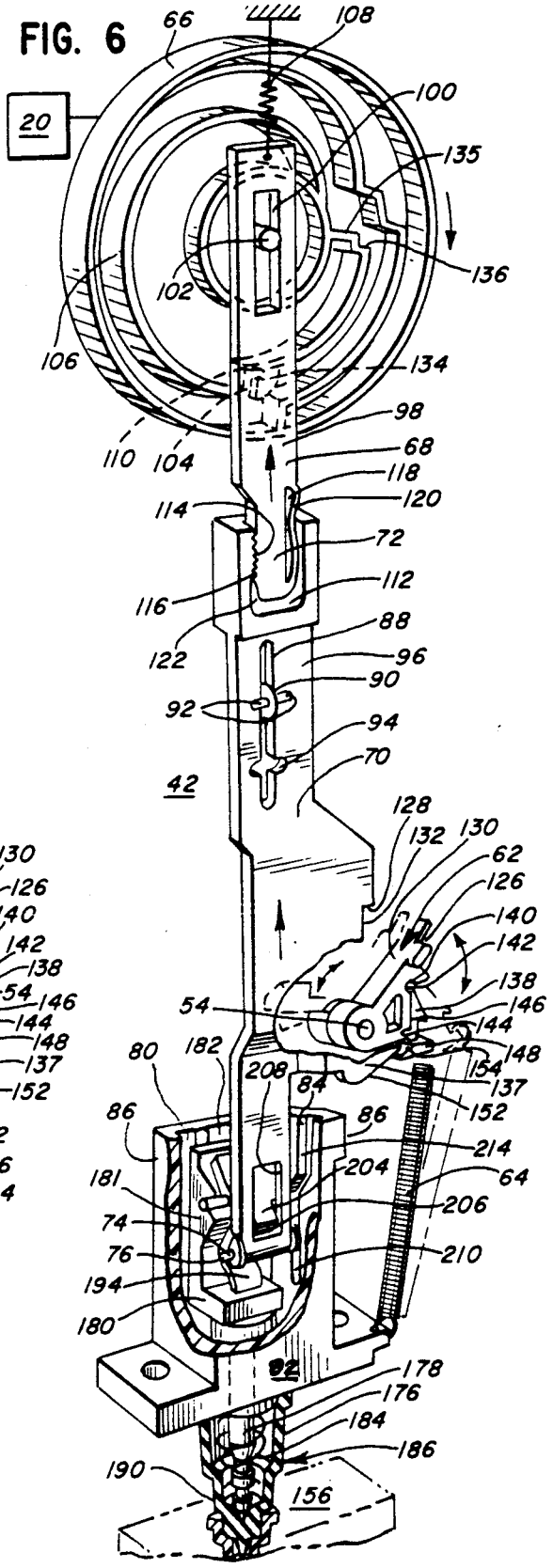
FIG. 6 is a view similar to that in FIG. 5 with the dispensing structure at a stage in the operating cycle wherein the detergent cover of FIG. 4 is released to an open position.

A further aspect of the invention is the use of a modular construction for the dispensing structure. As seen in FIGS. 5, 6 and 8, the block 82 is part of a module consisting of a trigger assembly 180, 194, and a plunger/-cover 176, which module is attachable as a unit to the container 156 as by screws 79 and can be operably connected to the actuating member/moving means 70 driven reciprocably by the timer mechanism 20.

In FIGS. 13–16, a modular construction for the mechanism acting between the link 384 and cover/-plunger 350 is shown. A self-contained pre-assembled module at 606 consisting of the guide member 361, the trigger 352 and the trigger moving member 382, is provided. The module 606 can be removably connected by conventional techniques, such as screws or cooperating tabs and shoulders, to the upper wall 608 (FIG. 16) of the reservoir 310. The trigger 352 is in the process operatively engaged with the cover 350. The drawing arm 408 of the link 384 is in turn attached to the trigger moving member 382.

The reservoir 310 has an annular neck 610 (FIG. 14) bounding the reservoir outlet. The neck 61 is defined cooperatively by a plurality of circumferentially spaced sections 612, each having a ramp surface 614. As the neck 610 is directed through a receptive opening 616 in the liner 336, the ramp surfaces 614 engage the liner 336 and are flexed progressively, radially inwardly sufficiently to allow the neck 610 to pass through the opening 616 so that the shoulders 618 on the sections 612 thereby move into facing relationship with the rearwardly facing surface 622 of the liner 336. The sections 612 spring back to an undeformed state so that the liner wall is captured between the shoulders 618 and a rearwardly facing surface 622 on the liner 336.

It can be seen that a module consisting of the module 606 in combination with the reservoir 310 and associated cover 350 can be operatively preassembled so that the larger module can be readily snap fit to the dishwasher after which simple interconnection to the link 384 can be carried out.

A further module is shown at 623 in FIGS. 19–21. The module 623 consists of guide member 457, trigger part 450 and trigger moving member 460. The guide member 457 has upper and lower resilient tabs 624, 626, respectively, which deflect vertically upwardly and downwardly, respectively, as the module 623 is pressed rearwardly against the liner 336. The tabs 624, 626 engage behind rearwardly facing shoulders 628, 630 (FIG. 19), respectively (FIG. 19), to maintain the module 623 on the liner 336. The trigger part 450 slides into operative engagement with the trigger part 442 as assembly of the module 623 to the liner 336 is effected. Link 384 can then be readily connected to the trigger moving member 460.

The foregoing disclosure of specific embodiments is intended to be illustrative of the broad concepts comprehended by the invention.

We claim:

1. Structure for dispensing an additive into a wash chamber of a dishwashing apparatus having a timer mechanism for automatically controlling operation of the dishwashing apparatus, said structure comprising:

a reservoir for storing a supply of additive and having an outlet opening in the wash chamber;

a cover for said reservoir;

means mounting the cover for movement relative to the reservoir between (a) a closed position wherein the cover prevents escape of additive from the reservoir outlet into the wash chamber and (b) an open position permitting the reservoir outlet to be in communication with the wash chamber;

a movable member connected to a moving means;

said moving means being driven by said timer mechanism for moving said movable member through a prescribed path in response to operation of the timer mechanism as the dishwashing apparatus is cycled through an operating cycle, said moving means moving said movable member in a first direction through a portion of said path during one portion of said operating cycle and moving said movable member to retrace said path portion in a second direction opposite to the first direction during another portion of said operating cycle;

a trigger operatively connected between said movable member and said cover;

means mounting the trigger in the path of said movable member so that the movable member moves against and past the trigger as said movable member moves in said path in both said first and second directions; and cooperating means on the trigger, movable member and cover for (a) causing said movable member to engage said trigger to move said cover relative to said reservoir to allow said cover to move from its closed position to its open position as said movable member moves in said first direction in said portion of said path, and (b) for permitting said movable member to move the trigger relative to the cover as said movable member moves in said second direction in said path without moving said cover from its closed position to its open position.

2. The additive dispensing structure according to claim 1 wherein the cover comprises a plunger that is normally spring biased sealingly against the reservoir outlet.

3. The additive dispensing structure according to claim 1 wherein said cover comprises a plunger which seats over the outlet in its closed position and unseats in its open position, the trigger has a collapsible section extending from said plunger, said movable member draws the trigger with it as it moves against said trigger in the first direction, thereby unseating the plunger and as the movable member moves in the direction opposite the first direction against the trigger the collapsible section collapses to allow passage of the movable member beyond the trigger without unseating the plunger.

4. The additive dispensing structure according to claim 1 wherein said cover comprises a plunger which seats over the outlet in its closed position and unseats in its open position, the trigger has a collapsible section extending from said plunger, said trigger comprises a projection defining a shoulder, a block member is provided and defines a guide slot and the movable member has a pin which is guided in the guide slot through the path portion, said pin, upon said movable member moving in the first direction, engaging said shoulder and moving the collapsible section and plunger to unseat the plunger, said pin, upon said movable member moving in said direction opposite the first direction, engaging the projection and collapsing the collapsible section as the pin moves against and beyond the projection without unseating the plunger.

5. The additive dispensing structure according to claim 1 wherein said cover comprises a plunger which seats over the outlet in its closed position and unseats in its open position, the trigger has a collapsible section extending from said plunger, said trigger comprises a projection defining a shoulder, block member is provided and defines a guide slot and the movable member has a pin which is guided in the guide slot through the path portion, said pin, upon said movable member moving in the first direction, engaging said shoulder and moving the collapsible section and plunger to unseat the plunger, said pin, upon said movable member moving in said direction opposite the first direction, engaging the projection and collapsing the collapsible section as the pin moves against and beyond the projection without unseating the plunger, wherein said slot comprises a vertical portion and an offset portion and the pin moves through the vertical portion and then said offset portion as the movable member moves in the first direction and as the pin moves into the offset portion the movable member separates from the trigger thereby allowing the cover to reseat.

6. The additive dispensing structure of claim 1 wherein there is a door with a liner on the dishwashing apparatus, said cover is pivotable between said open and closed positions, there is a latch connected to said trigger, means mounting the latch to the liner for movement between a first position wherein its blocks the cover in its closed position and a second position wherein the cover can be opened, means mounting said trigger for movement relative to the latch and upon said movable member moving against the trigger in the first direction the trigger causes the latch to move to its second position so that the cover can open and upon the movable member moving against and beyond the trigger in said direction opposite the first direction the trigger moves relative to the latch without causing movement of the latch.

7. Structure for dispensing an additive into a wash chamber of a dishwashing apparatus that is automatically controlled through an operating cycle by a timer mechanism, said structure comprising:

a reservoir for storing a supply of additive;

a cover for said reservoir;

means mounting the cover for movement relative to the reservoir between (a) a closed position wherein the cover prevents escape of additive from the reservoir into the wash chamber and (b) an open position where the reservoir is in communication with the wash chamber;

a latch engaging said cover;

means mounting the latch for movement relative to the cover between (a) a first position for maintaining the cover in said closed position and (b) a second position wherein the cover can be moved from the closed position to the open position;

a link operatively connected between said timer mechanism and a trigger arm;

means mounting the link for movement in response to operation of the timer mechanism through a prescribed path as the dishwashing apparatus is operated through an operating cycle, said link moving in a first direction through a portion of the path at one stage in an operating cycle and retracing said path portion in a direction opposite to the first direction at another stage in an operating cycle;

means cooperating between said trigger arm and said link for permitting engagement therebetween; and means mounting the trigger arm to the latch for movement relative to thereto so that (a) a part of the link moving in the first direction through said path portion engages and moves the trigger arm thereby causing the latch to move between the first and second positions as the link part moves against and beyond the trigger arm in said first direction and (b) said link part engages and moves the trigger arm relative to the latch as the part moves against and beyond the trigger arm with the link moving through said path portion in said direction opposite to the first direction without moving the latch between the first and second positions, whereby the latch moves from the first to the second position only with the link moving in the first direction.

8. The additive dispensing structure according to claim 7 wherein the means mounting the latch mount the latch pivotally between the first and second positions, a lever is provided on the latch and means mounting the trigger arm onto the lever so that as the link part moves against and beyond the trigger arm in the first direction of movement of the link the trigger arm bears against and moves the lever, and as the link part moves against the trigger arm in the direction opposite the first direction the trigger arm moves relative to the lever sufficiently to allow the link part to move beyond the trigger arm.

9. The additive dispensing structure according to claim 7 wherein the link movement is translatory in the path portion and the trigger arm is pivotally mounted for rotation relative to the lever.

10. In a dishwashing apparatus having a tub defining a wash chamber, said tub having an opening and an associated movable door for covering the opening, means defining a reservoir, dispensing structure for delivering an additive from said reservoir into the wash chamber, a timer mechanism for controlling operation of the dishwashing apparatus in a dishwashing cycle, cam means on the timer mechanism for controlling operation of the dishwashing apparatus in a dishwashing cycle, cam means on the timer mechanism for controlling operation of the dispensing structure for causing delivery of additive from the reservoir to said wash chamber at a preselected time in the dishwashing cycle, and actuating structure interconnecting the timer mechanism and dispensing structure, said actuating structure comprising:

an elongate actuating link;

means mounting the actuating link to the door for longitudinal movement;

means connecting said cam means on said timer mechanism to said actuating link for causing longitudinal movement of said actuating link through a prescribed path, said connecting means moving said actuating link in a first longitudinal direction through a portion of said prescribed path during a first portion of the dishwashing cycle and during a second portion of the dishwashing cycle through said path portion in a direction opposite said first direction;

a cover for said reservoir;

means movably mounting the cover to the door for movement between an open position and a closed position, including means for biasing said cover to said open position;

a latch for said cover mounted rotatably between a first position and a second position;

said latch in said first position locking said cover in a closed position, said latch in said second position releasing said cover to allow said biasing means to move said cover to its open position;

a trigger;

means movably mounting the trigger to the latch in the path of the actuating link to be engaged by the actuating link; and cooperating means on the trigger, latch, and actuating link for (a) movement of the trigger against the latch for movement of the latch from its first position to its second position upon the actuating link moving in the first longitudinal direction and (b) movement of the trigger relative to the latch without moving the latch with the latch in its first position as the actuating link moves in the opposite longitudinal direction against and past the trigger, whereby said cover is released to said open position only when said actuating link moves against and past said trigger in said first longitudinal direction.

11. The actuating structure according to claim 10 wherein the means for moving said latch comprises a lever, means pivotally mounting the lever to the latch for rotation about a first axis and means mounting the trigger to the lever for rotation about a second axis that is substantially parallel to the first axis.

12. The actuating structure according to claim 10 wherein the means for moving said latch comprises a lever, means pivotally mounting the lever to the latch for rotation about a first axis and means mounting the trigger to the lever for rotation about a second axis.

13. The actuating structure according to claim 10 wherein the means for moving said latch comprises a lever, means pivotally mounting said lever to the latch for rotation about a first axis, means mounting the trigger to the lever for rotation about a second axis, whereby movement of the link in the first longitudinal direction bears the trigger against the lever so that the lever pivots, thereby allowing the lever to move the latch from the first position to the second position and movement of the link in the opposite longitudinal direction pivots the trigger in a first rotational direction relative to the lever without pivoting the lever.

14. The actuating structure according to claim 10 wherein the means for moving said latch comprises a lever, means pivotally mounting said lever to the latch for rotation about a first axis, means mounting the trigger to the lever for rotation about a second axis, whereby movement of the link in the first longitudinal direction bears the trigger against the lever so that the lever pivots, thereby allowing the lever to move the latch from the first position to the second position and movement of the link in the opposite longitudinal direction pivots the trigger in a first rotational direction relative to the lever without pivoting the lever and further including means biasing the trigger in a rotational direction opposite to the first rotational direction.

15. The actuating structure according to claim 10 including means biasing the latch to its first position.

16. The actuating structure according to claim 10 wherein the means for moving said latch comprises a lever, means pivotally mounting said lever to the latch for rotation about a first axis, means mounting the trigger to the lever for rotation about a second axis, whereby movement of the link in the first longitudinal direction bears the trigger against the lever so that the lever pivots, thereby allowing the lever to move the latch from the first position to the second position and movement of the link in the opposite longitudinal direction pivots the trigger in a first rotational direction relative to the lever without pivoting the lever and further including means biasing the trigger in a rotational direction opposite to the first rotational direction and against the lever so that the lever biases the latch towards the first position.

17. The actuating structure according to claim 10 wherein said cooperating means comprises said trigger having an arm and a portion of the link moves against said trigger arm upon the link moving through said path portion, there is a ramped surface on at least one of the trigger arm and link portion, said ramped surface on the one of the trigger arm and link portion is in the path of and engages the other of the trigger arm and link portion as the link moves in the first direction and thereby shifts the trigger causing movement of the latch between its first and second positions.

* * * * *